US005595084A

United States Patent [19]

Yano

[11] Patent Number: 5,595,084

[45] Date of Patent: Jan. 21, 1997

[54] HOLLOW DIE AND AN APPARATUS FOR CONTINUOUS EXTRUSION FORMING OF HOLLOW ARTICLES

[75] Inventor: Sadahide Yano, Osaka, Japan

[73] Assignee: Yugen Kaisha Yano Engineering, Osaka, Japan

[21] Appl. No.: 410,513

[22] Filed: Mar. 24, 1995

[30] Foreign Application Priority Data

Apr. 12, 1994 [JP] Japan ..... 6-073501

[51] Int. Cl.[6] ..... B21C 23/00

[52] U.S. Cl. ..... 72/262; 72/269

[58] Field of Search ..... 72/262, 265, 269, 72/272

[56] References Cited

U.S. PATENT DOCUMENTS

| | | | |
|---|---|---|---|
| 4,313,327 | 2/1982 | O'Connor . | |
| 4,598,567 | 7/1986 | Backus | 72/262 |
| 4,829,802 | 5/1989 | Baumann | 72/272 |
| 5,131,253 | 7/1992 | Hopkins . | |
| 5,152,163 | 10/1992 | Hawkes et al. | 72/262 |

FOREIGN PATENT DOCUMENTS

| | | | |
|---|---|---|---|
| 0127924 | 12/1984 | European Pat. Off. . | |
| 0233064 | 8/1987 | European Pat. Off. . | |
| 0363667 | 4/1990 | European Pat. Off. | 72/262 |
| 5588926 | 7/1980 | Japan | 72/262 |
| 0156833 | 9/1982 | Japan | 72/262 |
| 0161420 | 7/1987 | Japan | 72/262 |
| 2103527 | 2/1983 | United Kingdom . | |
| 2241660 | 9/1991 | United Kingdom | 72/262 |

*Primary Examiner*—Daniel C. Crane
*Assistant Examiner*—Ed Tolan
*Attorney, Agent, or Firm*—Armstrong, Westerman, Hattori, McLeland & Naughton

[57] ABSTRACT

A hollow die (5) for extruding elongate hollow articles has a thick cylindrical body (15), whose cavity (23) extends in the axial direction of the die. This cavity receives and holds a core (7), a female member (21) and other necessary parts in alignment with each other in the axial direction. The hollow die is thus of such a high rigidity that higher extrusion rates will not cause any intolerable distortion or the like deformation in the die, thereby enhancing the productivity and the dimensional precision of the extrudates. The hollow die is particularly adapted for use with the continuous extrusion forming apparatuses.

6 Claims, 11 Drawing Sheets

HOLLOW DIE AND AN APPARATUS FOR CONTINUOUS EXTRUSION FORMING OF HOLLOW ARTICLES

BACKGROUND OF THE INVENTION

1. Field of the Invention

The present invention relates to a hollow die and an apparatus for continuous extrusion forming of hollow articles made of a metal such as aluminum.

2. Prior Art

The so called, continuous extrusion forming apparatus is known in the art. This apparatus may be used to continuously extrude hollow metal articles, such as aluminum tubes 'E'. Those tubes are, for example, of a profile as shown in FIG. 8, and are used in manufacture of heat exchangers.

FIG. 10 shows the principle of the continuous extrusion forming apparatus. This apparatus comprises an extrusion wheel 52 having an annular groove 51 formed therearound. A wire or the like material 'M' for extrusion will be guided along this groove of the continuously rotating wheel 52. Shoes 53 are in a sliding contact with the outer periphery of the wheel, so as to accommodate feed plates 54 and 55 in place. The feed plates are arranged fore and aft to extend a distance around the wheel, and cover the annular groove 51 to form a pressure chamber within the shoes. A die 57 is held outside the innermost feed plate 54, and an abutment 59 is positioned ahead this plate circumferentially of the wheel 52. A foot of the abutment 59 protrudes into the annular groove 51. A short enlarged groove 60 formed in the innermost feed plate 54 faces and cooperates with the annular groove, thereby providing the pressure chamber with a sufficient space.

The continuous extrusion forming apparatus outlined above will operate as follows. The wheel 52 whose groove 51 is guiding the wire-shaped material M is driven to rotate and force this material in between the wheel and the feed plates 54 and 55. Consequently, the material will be compressed in the pressure chamber 61 defined between the wheel 51, the feed plates 54 and 55 and the abutment 59. The material thus compressed will be extruded through the die 57 to produce an extrudate of a desired configuration.

In general, the die assemblies used in the continuous extrusion forming apparatus have been split dies 57 each composed of a male die 62 and a female die 63. As shown in FIGS. 9A and 9B, the male die 62 comprises a short and thick columnar body 64 and a bridge 65 integral therewith. This bridge 65 crosses a cavity defined through and centrally of the body. A core 66 having a bearing tip 67 for defining a hollow longitudinal space through the extrudate is secured in the bridge, such that the tip protrudes forwardly of the male die. On the other hand, the female die 63 Comprises a thick disc 69 of the same outer diameter as the columnar body 64 of the male die. A forming hole 70 is formed through the thick disc so as to define the outer periphery of said extrudate. In this split die, the male die 62 is located behind the female die 63 in the direction of extrusion.

A higher extrusion speed which has been desired to raise productivity, inevitably cause a stronger stress to be imposed on the die 57. Such a stress will bend the die and result in an irregular configuration of the forming slit 71, thus failing to produce high precision extrudates.

This problem is not necessarily inherent only in the continuous extrusion forming apparatuses each having the die 57 as described above. However, as shown in FIG. 11, the innermost feed plate 54 in said apparatus tends to get warped due to the high pressure of material 'M' compressed in the enlarged groove 60. FIGS. 9A and 9B illustrate that such a deformation of the plate 54 will bring about an asymmetrical deformation of the die 57. A distorted forming slit 71 in the die causes a serious defect in the dimensional preciseness of extrudates 'E'.

OBJECTS OF THE INVENTION

In view of the described problems in the prior art die and apparatus, an object of the present invention is to provide a hollow die and an apparatus comprising the die for continuous extrusion forming of hollow articles, wherein the die is protected from distortion even at raised extrusion speeds, so that high quality extrudates can be produced efficiently.

Other objects and advantages will become apparent from embodiments given below. It will also be understood that the embodiments may be modified freely within the spirit and scope of the invention.

SUMMARY OF THE INVENTION

According to the present invention, a hollow die is provided which comprises a thick cylindrical body, a cavity formed therethrough to be coaxial therewith, a bridge formed integral with the body and across an upstream region of the cavity, a core mounted on the bridge and having a bearing tip for defining at least one hollow longitudinal space through an extrudate, the bearing tip protruding forwardly into a middle region of the cavity, and a female member secured in a downstream region of the cavity and having a forming hole surrounding the bearing tip so as to define an outer periphery of the extrudate, wherein a forming slit is provided between the forming hole and the bearing tip. The words 'upstream'. 'middle' and 'downstream' are used above and hereinafter in relation to the direction in which a material is extruded through this die.

The hollow die summarized above may be adapted for use in the continuous extrusion forming of hollow articles.

From another aspect, the present invention provides an apparatus for continuous extrusion forming of hollow articles, and the apparatus comprises an extrusion wheel having an outer periphery and capable of rotating, a main guide groove formed in and along the periphery, an inner feed plate having an arcuate inner surface and a flat outer surface, the inner surface being in a sliding contact with the outer periphery, an auxiliary guide groove formed in and along the inner surface so as to be in register with the main guide groove, and a hollow die fixedly supported by the flat outer surface of the inner feed plate, the hollow die comprising: a thick cylindrical body; a cavity formed therethrough to be coaxial therewith; a bridge formed integral with the body and across an upstream region of the cavity; a core mounted on the bridge and having a bearing tip for defining at least one hollow longitudinal space through an extrudate; the bearing tip protruding forwardly into a middle region of the cavity; and a female member secured in a downstream region of the cavity and having a forming hole surrounding the bearing tip so as to define an outer periphery of the extrudate, wherein a forming slit is provided between the forming hole and the bearing tip.

Usually, a seal ring may be interposed between the hollow die and the flat outer surface of the feed plate.

DESCRIPTION OF THE PREFERRED EMBODIMENTS

Figure 1:
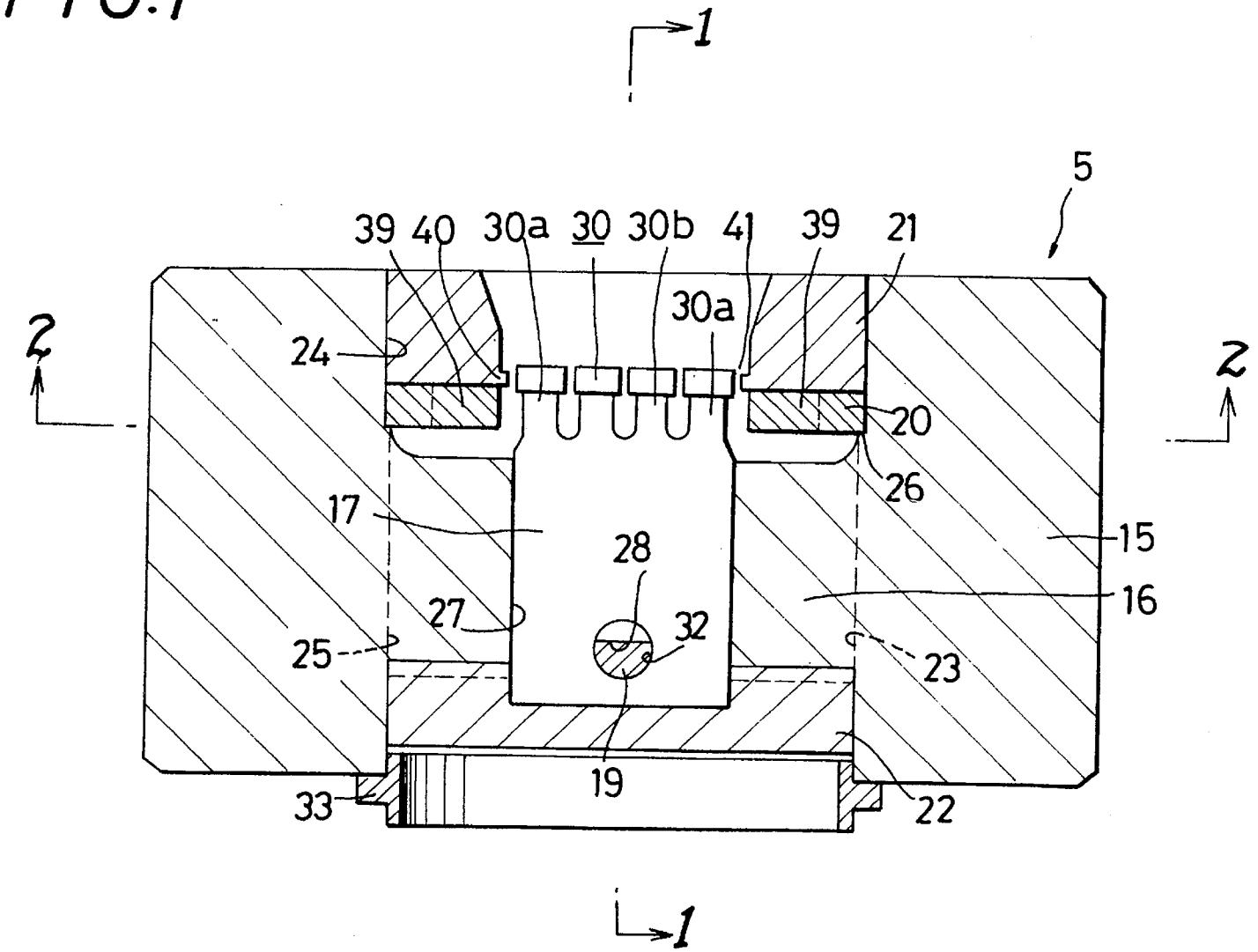
FIG. 1 is a vertical cross section of a hollow die provided in an embodiment.

Now, embodiments of the present invention will be described in detail referring to the drawings.

Figure 8:
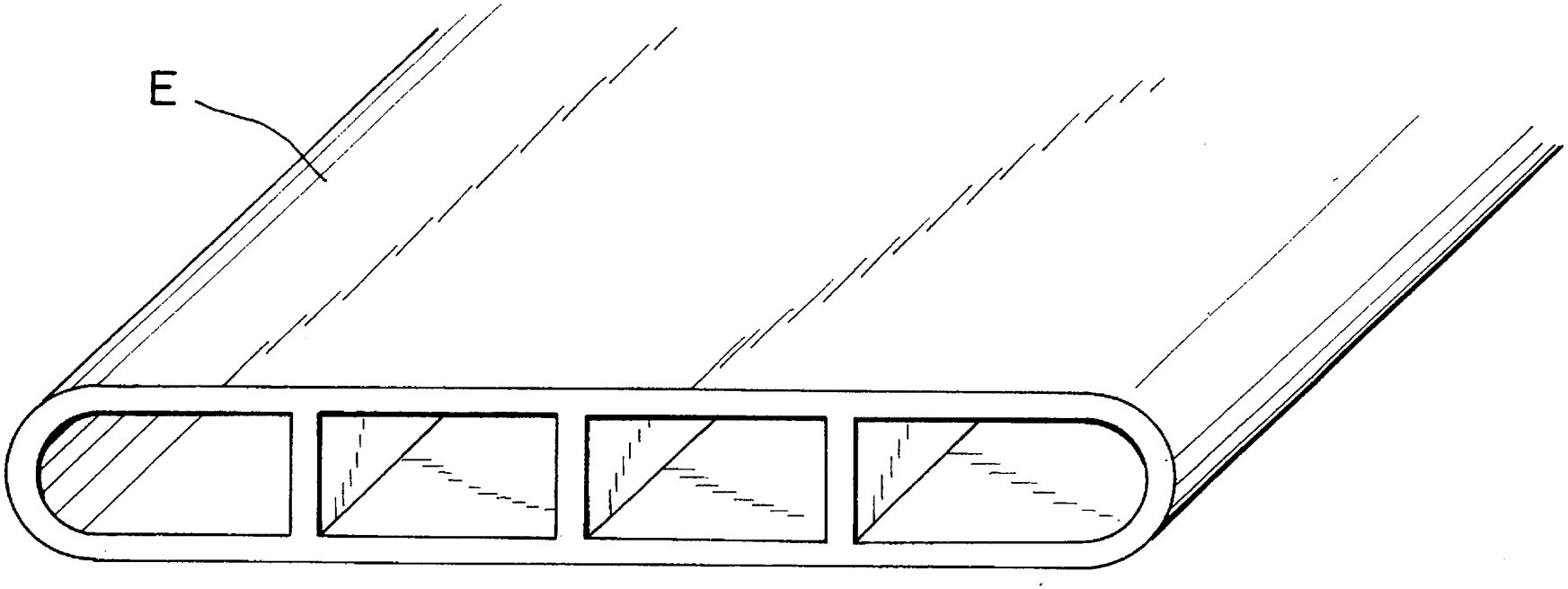
FIG. 8 is a perspective view of a tube as an example of the extrudates, the tube being one part constructing a heat exchanger.
Figure 9B:
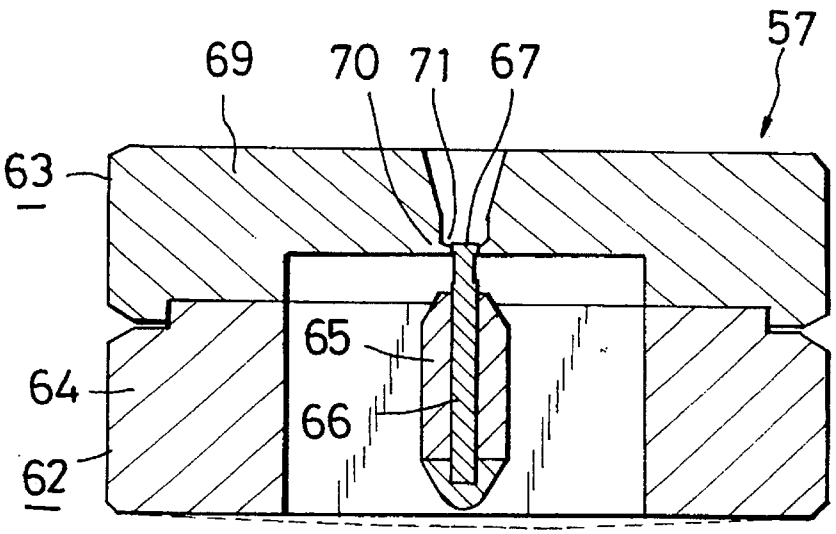
FIG. 9B (PRIOR ART)
FIG. 9B is a cross section taken along the line 4—4 FIG. 9A.
Figure 9A:
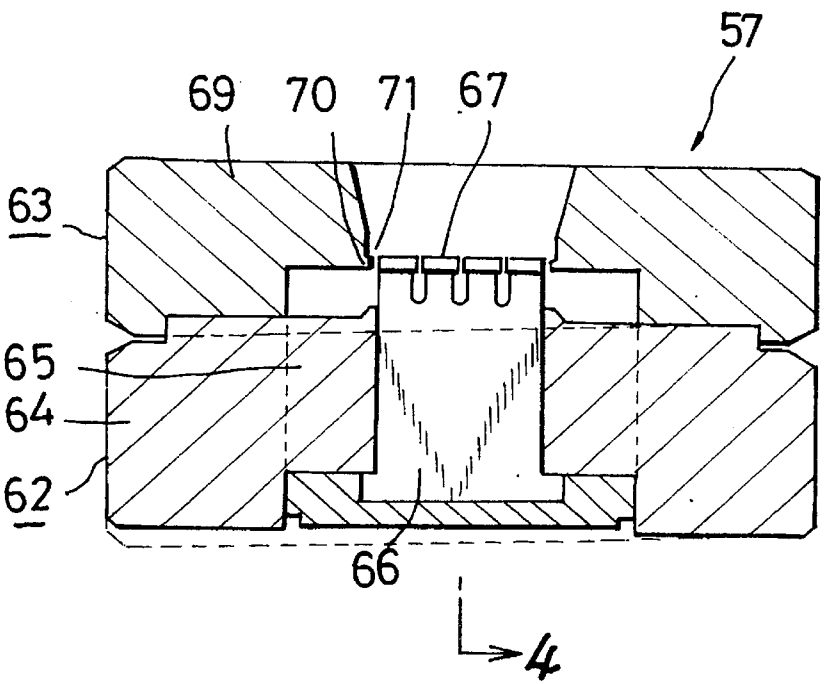
FIG. 9A (PRIOR ART)
FIG. 9A is a vertical cross section of a prior art hollow die.
Figure 10:
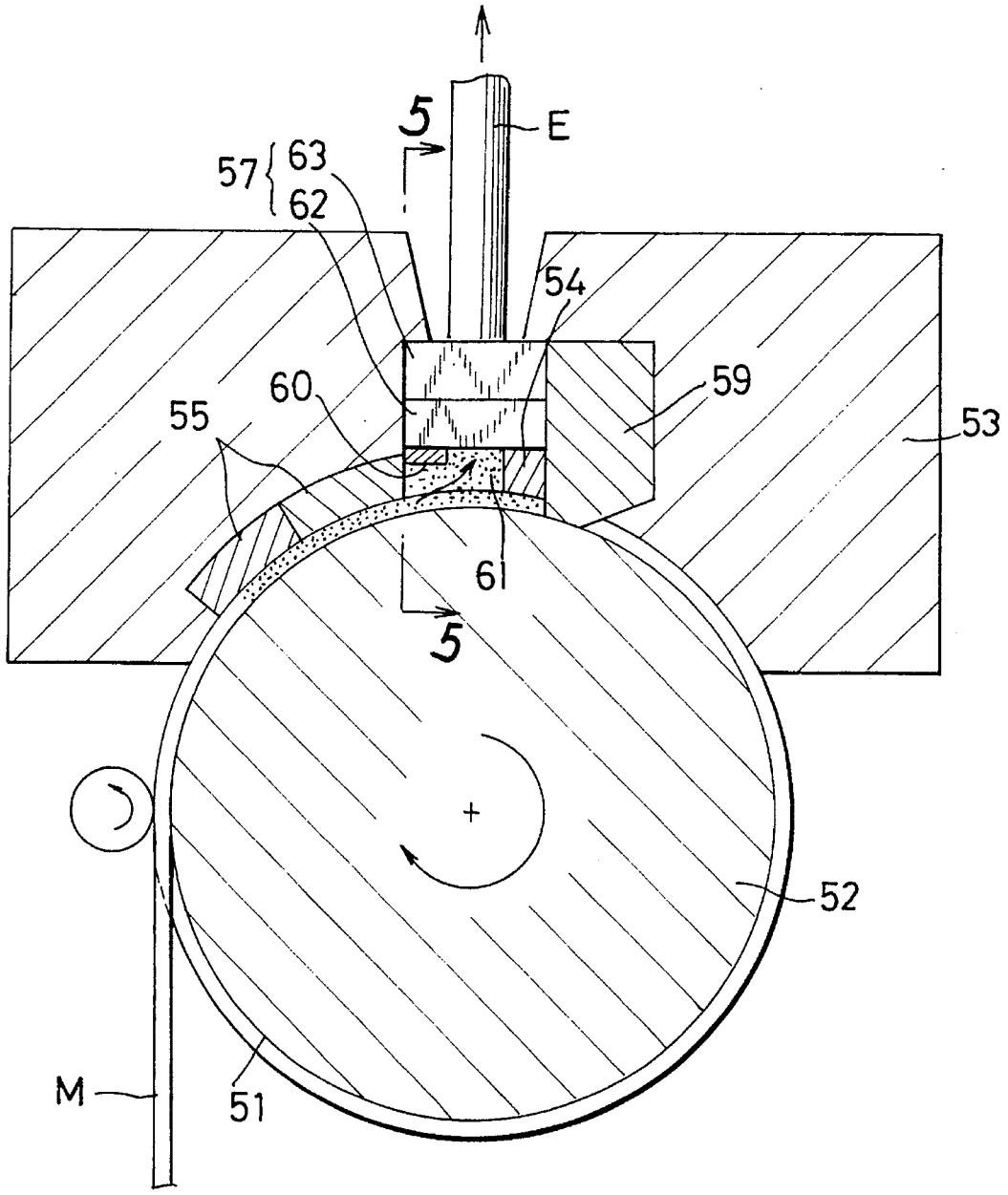
FIG. 10 (PRIOR ART)
FIG. 10 is a cross section of a prior art apparatus for continuous extrusion forming of hollow articles.
Figure 11:
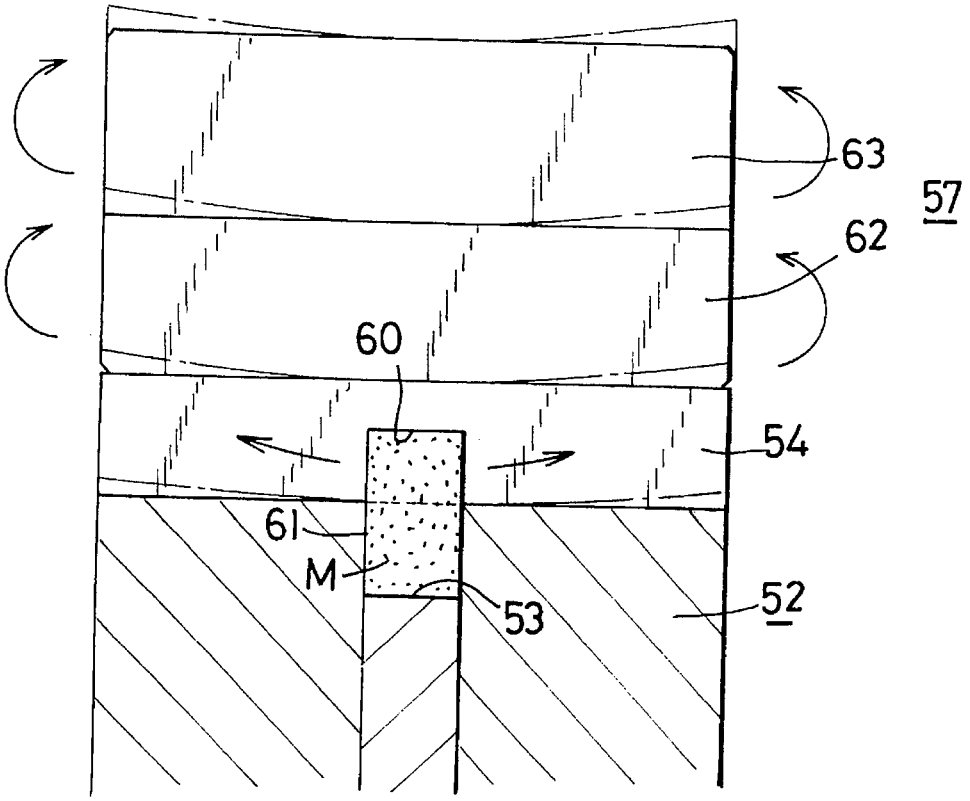
FIG. 11 (PRIOR ART)
FIG. 11 is a cross section taken along the line 5—5 in FIG. 10.

A hollow extrudate produced in the embodiment is a flat and perforated aluminum tube 'E'. A plurality of such tubes shown in FIG. 8 are adapted to construct, for example, a heat exchanger. However, the embodiment may be applied to production of any other hollow articles.

Figure 5:
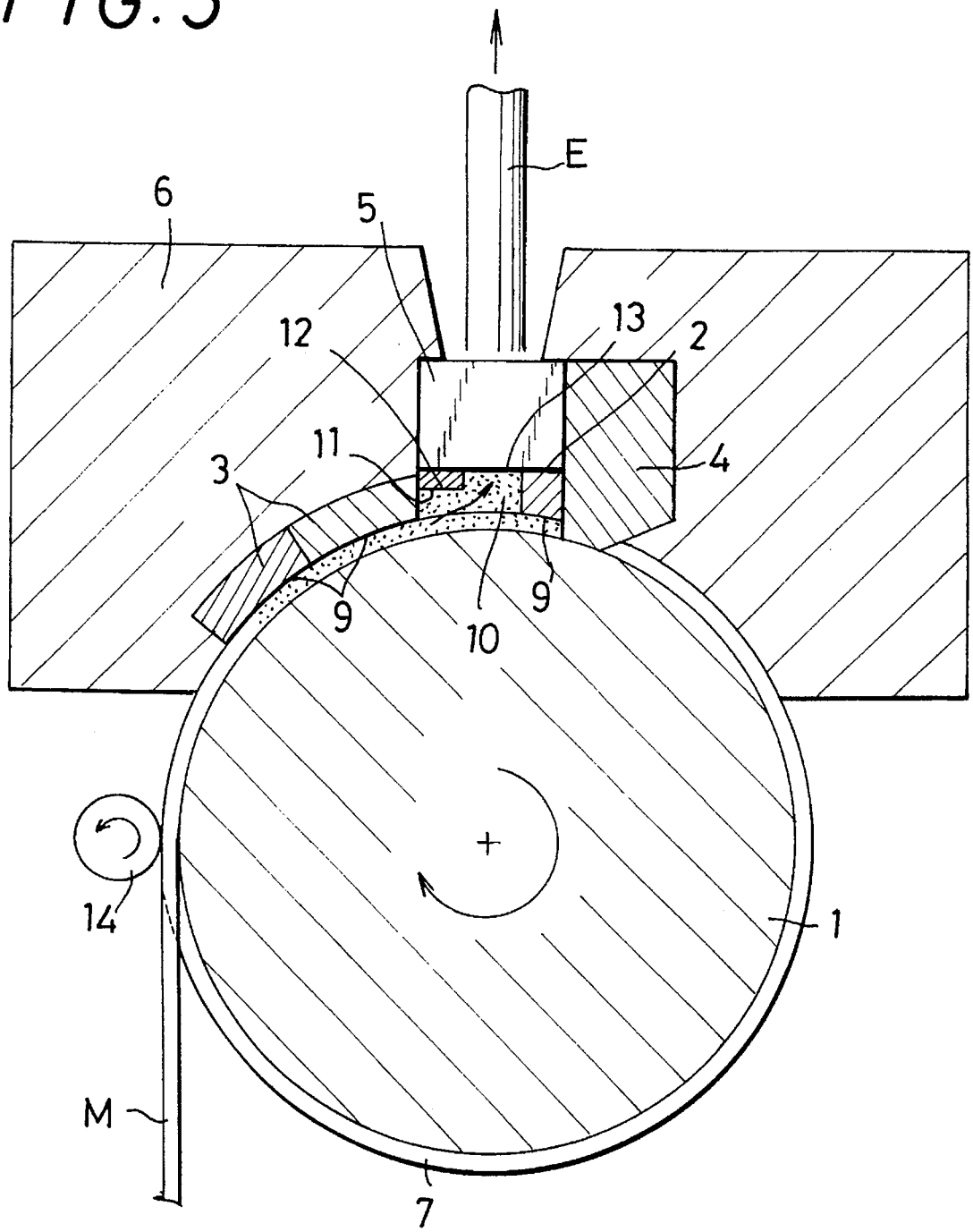
FIG. 5 is a cross section of some parts included in an apparatus for continuous extrusion forming of hollow articles, the apparatus using the hollow die.
Figure 6:
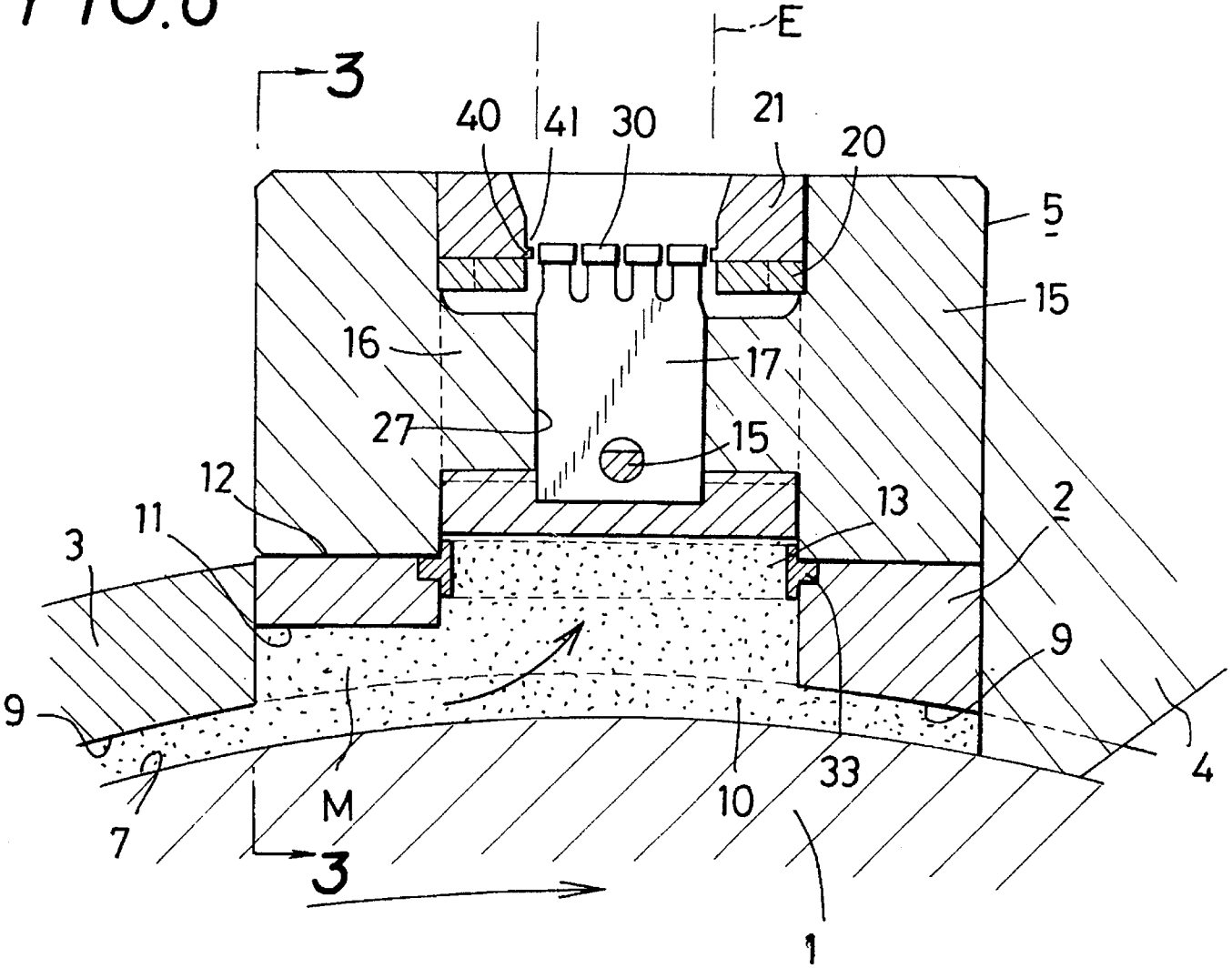
FIG. 6 is an enlarged cross section of the essential parts of the apparatus shown in FIG. 5.
Figure 7:
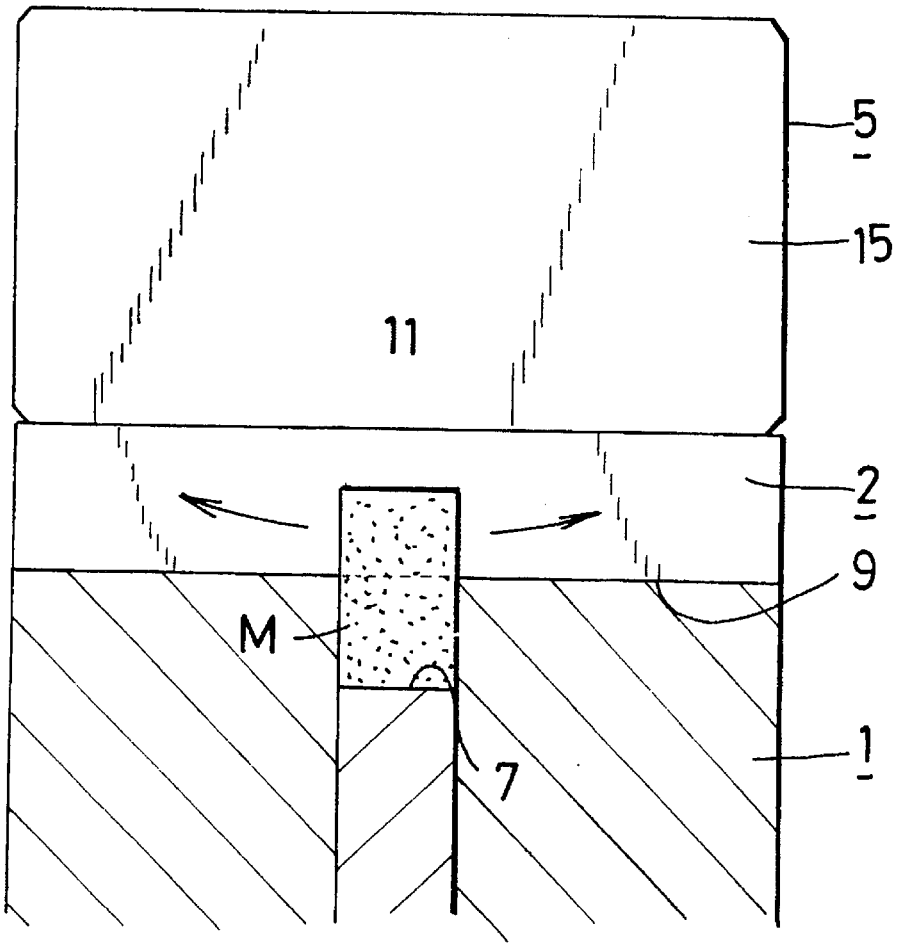
FIG. 7 is a cross section taken along the line 3—3 in FIG. 6.

FIGS. 5–7 show an apparatus for continuous extrusion forming of hollow articles, in which the reference numeral 1 denotes an extrusion wheel. The numerals 2 and 3 denote feed plates, with the numerals 4, 5 and 6 denoting an abutment, a hollow die and a pair of shoes, respectively.

The extrusion wheel 1 having a guide groove 7 formed in an outer periphery of said wheel is driven to rotate by a drive mechanism not shown. A raw material 'M' subject to the extrusion is an aluminum wire guided along the groove 7. An intensive friction between this wire 'M' and the rotating wheel 1 will force the former to advance along the latter.

The plurality of the feed plates 2 and 3 are in contact with each other to form a row extending along the periphery of the wheel 1. An arcuate inner face 9 of each plate is in a sliding contact with the periphery of the wheel 1. Thus, the feed plates 2 and 3 cover the guide groove 7 in the periphery of said wheel so as to provide an outer peripheral wall or ceiling of a pressure chamber 10. A groove 11 facing the guide groove 7 in the wheel 1 is formed in a middle portion of the innermost feed plate 2, so that the pressure chamber 10 is of a sufficient volume. A flat outer face 12 of the innermost feed plate 2 supports the die 5. An opening 13 formed through the outer face 12 communicates with the pressure chamber 10.

The abutment 4 is located ahead the innermost feed plate 2, in the direction of rotation of the wheel, and has a lug protruding into the guide groove 7 and in a sliding contact with said wheel. The pressure chamber 10 having its inner end closed by the abutment is thus defined between this abutment 4 and the feed plates 2 and 3.

The pair of shoes 6 hold the feed plates 2 and 3, the abutment 4 and the die 5. The reference numeral 14 denotes a coining roll.

The hollow die 5 detailed in FIGS. 1–4 comprises a thick cylindrical body 15, a bridge 16 formed integral therewith, a core 17 mounted on the bridge, a pin 19 for holding in place the core, a flow regulating member 20, a female member 21 and a cap 22.

The thick cylindrical body 15 made of a die steel, or the like, has a round outer periphery and a round cylindrical cavity 23 formed therethrough to be coaxial therewith. A 'downstream' region (in the sense set forth hereinbefore) 24 of this cavity 23 is of a diameter a little greater than that of an 'upstream' region 25, so that an annular shoulder 26 is provided between the regions.

The straight single bridge 16 is integral with the body 15 and extends across the upstream region 25 of the cavity. An upstream face of the bridge is recessed forwardly a distance from the rearward face of the body 15.

Figure 2:
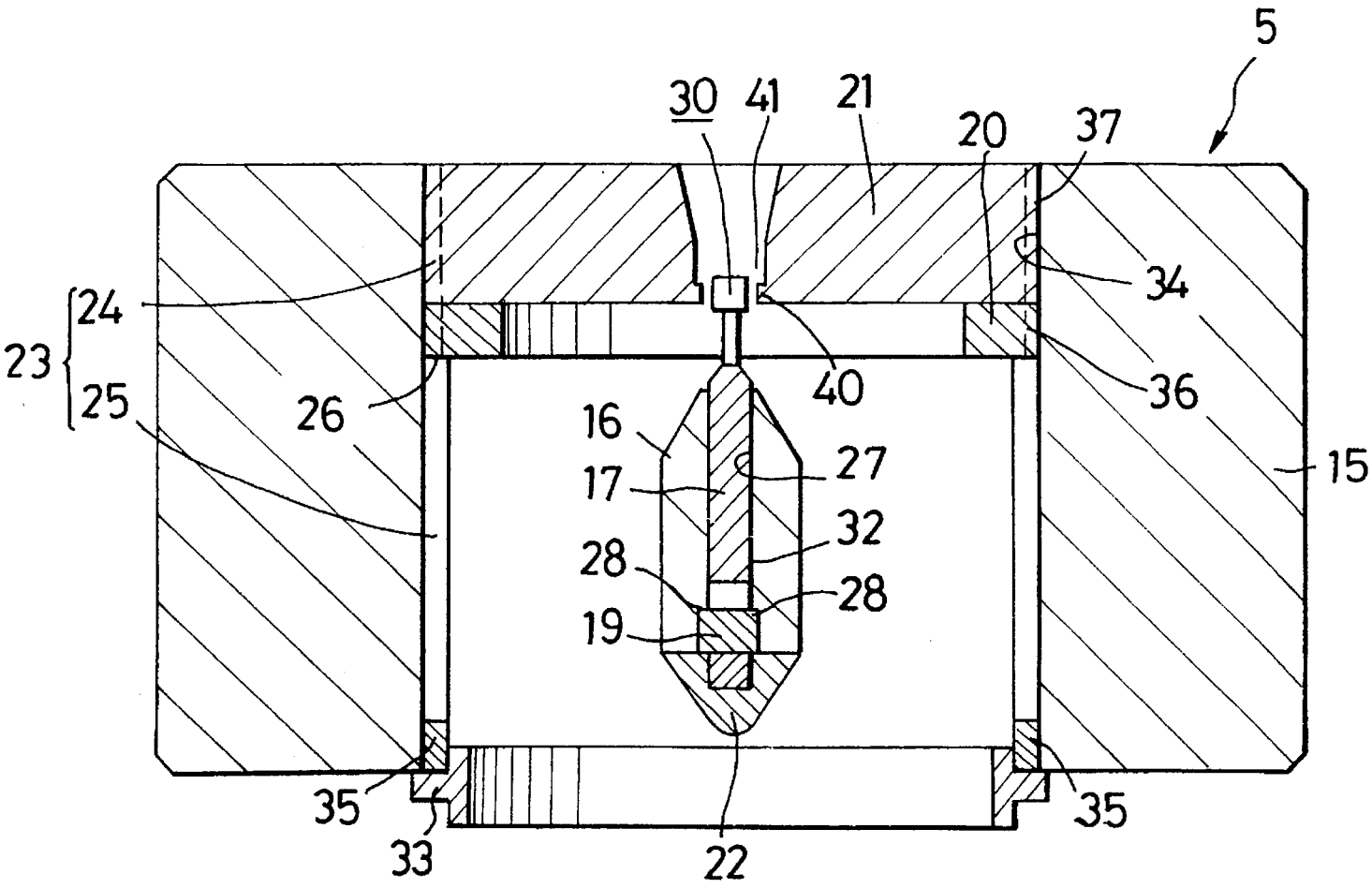
FIG. 2 is a cross section taken along the line 1—1 in FIG. 1.
Figure 3:
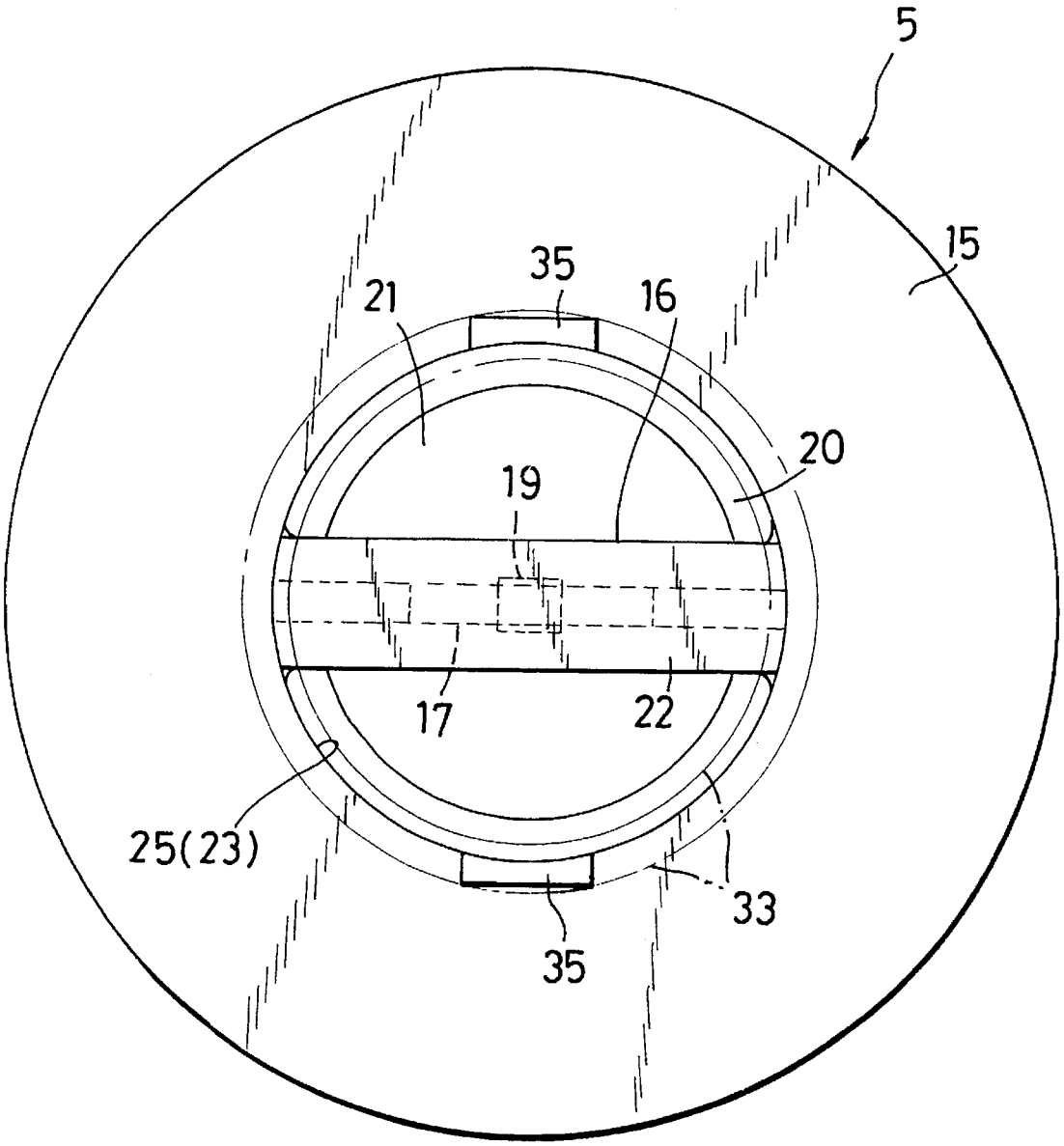
FIG. 3 is a plan view of the hollow die, seen from the upstream side thereof.

A slot 27 for receiving the core penetrates the bridge 16 in the fore and aft direction. As shown in FIG. 2, a pair of shoulders 28 are formed transversely in the slot, at a middle point thereof. Those shoulders 28 face the upstream end of the cylindrical body.

The core 17, which is a thick plate made of a hard material such as a hard metal (viz. cemented carbide ), has a comb-shaped bearing tip 30 for defining the hollow longitudinal spaces through the extrudate 'E'. A pin hole 32 penetrates transversely a middle rearward portion of the core 17. The pin 19, semicircular in cross section, is inserted in the hole 32 so that opposite flat end sides of the pin bear against the shoulders 28 formed in the bridge's slot 27, in which the core is placed. The bearing tip 30 of the core 17 protrudes forwardly into a middle region of the cavity, ahead of the downstream face of said bridge.

The cap 22 fits in the cavity to cover the upstream face of the bridge 16. The rear surface of this cap is located forwardly of the rear face of the cylindrical body 15, so that the material 'M' can smoothly enter the cavity 25. A seal ring 33 fitted in the upstream opening of the cavity 23 does not interfere with the cap 22. As shown in FIG. 2, this cap is saddle-shaped to have its central portion protruding rearwardly, whereby the material flow is smoothly divided into tributaries separated by the bridge.

Longitudinal grooves 34 each extending over the full length of the body 15 are formed in the inner periphery of the cavity 23 and at an angular shift by 90 degrees relative to the bridge 16. An upstream end of each groove 34 is closed with an amount of welded metal 35.

Accommodated in the downstream large-diameter region of the cavity 24 formed through the cylindrical body 15 are the flow regulating member 20 and the female member 21. The former member 20 is in contact with the annular shoulder 26, with the latter member 21 being located outside the former member. Both the members 20 and 21 have their outer peripheries in close contact with the inner periphery of said cavity 24.

A pair of longitudinal ridges 36 protrude from the outer periphery of the flow regulating member 20, in parallel with the axis of the cavity and at angular intervals of 180 degrees. A pair of similar ridges 37 protrude likewise from the outer periphery of the female member 21, so that both the members 20 and 21 are kept in correct place within the cavity 24 of the cylindrical body 15.

Figure 4:
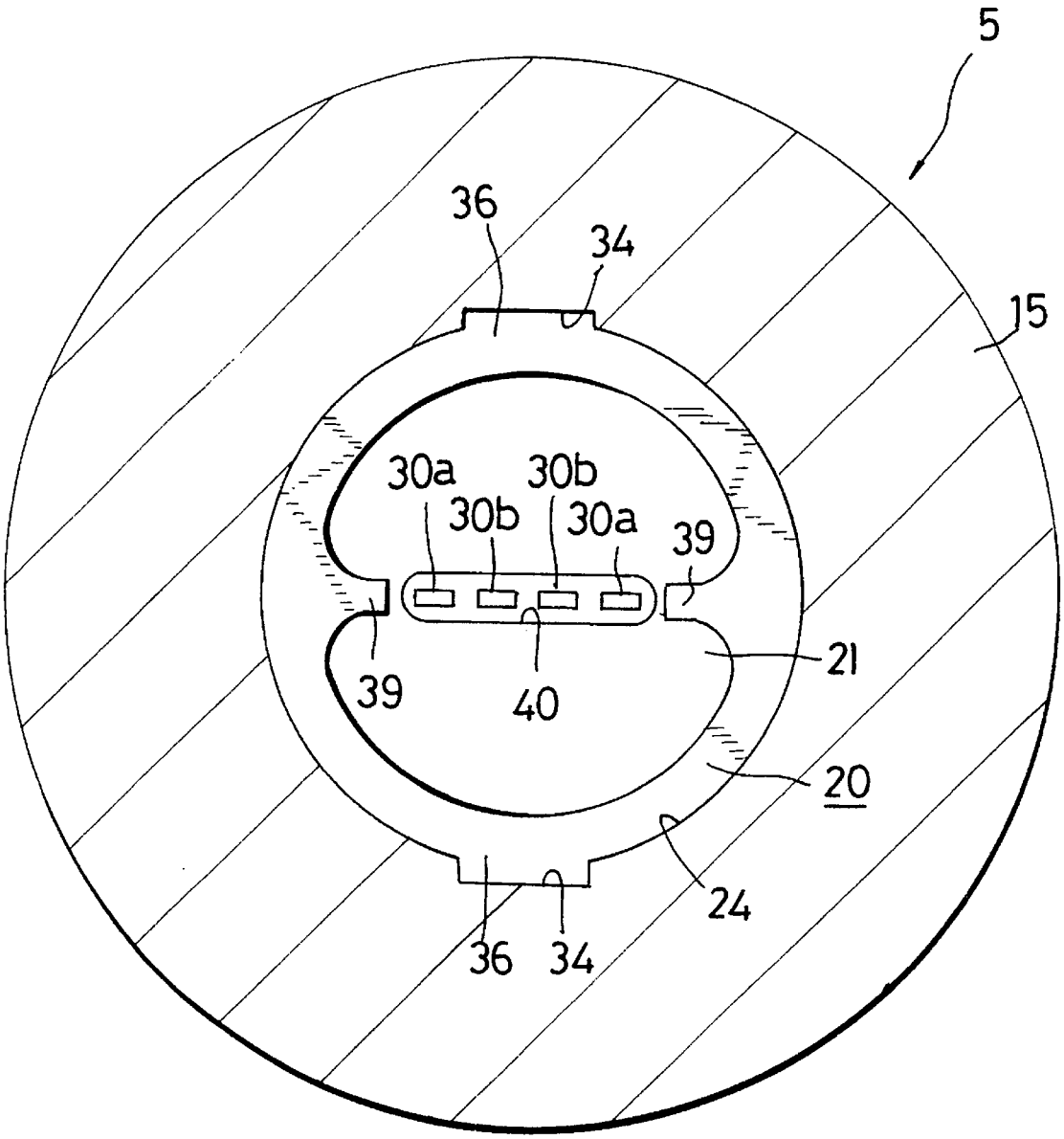
FIG. 4 is a cross section taken along the line 2—2 in FIG. 1.

FIG. 4 shows that the flow regulating member 20 is substantially of an annular shape. Centripetal lugs 39 protrude from the inner periphery of this member 20 towards the lateral edges of comb-shaped bearing tip 30 of the core 17. The tip 30 consists of outer teeth 30*a* and inner teeth 30*b* located between the outer teeth and aligned therewith. The distance between each centripetal lug 39 and the corresponding outer tooth 30*a* is substantially equal to the distance between the inner teeth 30*b* and 30*b*.

The female member 21 is made of a hard material such as a hard metal, and has a forming hole 40 of an elliptic cross section so as to define an outer peripheral surface for the tube 'E' to be extruded. The female member 21 is secured in the downstream large-diameter region 24 of the cavity of the cylindrical body 15. The bearing tip 30 of the core 17 is surrounded by the forming hole 40. Thus, a forming slit 41 for determining the cross-sectional shape of the extrudate 'E' is provided between said tip 30 and said hole 40. The female member 21 is shrinkage-fitted in the thick cylindrical body 15.

The hollow die 5 is supported on the flat outer face 12 of the innermost feed plate 2, with the seal ring 33 intervening between them as shown in FIG. 6. The interior of the hollow die 5 communicates with the opening 13 through which the raw material forcibly advances into the female member. The hollow die 5 incorporated in the continuous extrusion forming apparatus takes a position therein such that the bridge 16 extends tangentially of the extrusion wheel 1.

In operation of the apparatus, the wire 'M' as the raw material to be extruded will be guided along the groove 7 and thus around the wheel 1. The friction between the wire and the rotating wheel is effective to force the wire 'M' into the pressure chamber 10 defined within the shoes 6. The material of wire 'M' thus compressed in the chamber 10, will then be driven trough the innermost feed plate 2 and into the die 5, thus being extruded to form a tube 'E'.

At high extrusion rates, the material 'M' compressed in the groove 11 of innermost feed plate 2 will cause a strong stress therein. This stress imparted to both the lateral sides of the plate 2 is in such a direction that those sides tend to be distorted as shown by the arrows in FIG. 7. The strong stress is of course transmitted to the die 5, but will scarcely cause any noticeable distortion or deformation thereof that have been unavoidable in the prior art split dies 57. This is because the thick cylindrical body 15 is an integral rigid piece which extends the full axial length of the die provided herein. Accordingly, the forming slit 41 will remain undeformed for a longer period, and now high quality extrudates 'E' of higher dimensional preciseness will be produced efficiently even at the high extrusion rates.

Such a rigid die 5 maintains the sealing effect of the ring 33 during the extrusion process, and protects the ring from deformation or damage.

The rigid die 5 also protects the feed plate 2 from any deformation thereof that would cause the rotating wheel 1 to scratch said plate to produce chips. It is noted that those chips frequently produced in the prior art apparatuses have been taken into the material 'M' to thereby damage the prior art dies.

The distance between the lug 39 of flow regulating member 20 and the corresponding outer tooth 30*a* of bearing tip 30 is substantially equal to that present between the adjacent teeth 30*a* and 30*b* of said tip, as shown in FIG. 4 and as mentioned above. Pressure distribution thus equalized around every tooth will render more durable the core 17 and the die 5 as a whole.

The cavity 23 may be formed through the thick cylindrical body 15 as the principal part of the integral die 5, in an inexpensive and easy manner by the so-called 'wire-cut electric-spark' method and a subsequent machining using a lathe. In detail, the bridge 16 integral with the body and the longitudinal grooves 34 are formed at first by the electric spark method. Thereafter, the downstream region 24 of said cavity will be machined to have a larger diameter, and the upstream end of said cavity is machined to provide the space for accommodation of the cap 22 located behind the bridge.

The hollow die provided herein is not limited for use in the continuous extrusion forming apparatuses, but may be used in any batchwise extruders using billets of a raw material. In any case, the present hollow die will enhance the dimensional precision of extrudates, even at raised extrusion rates.

In summary, the thick cylindrical wall of the hollow die body extends the full length thereof and has the bridge and space for respectively receiving the core and female member. Such an integral and rigid structure is free from distortion or deformation of the forming slit, thereby efficiently producing the high precision hollow articles at higher extrusion speeds.

The continuous extrusion forming apparatus provided herein comprises such an improved hollow die. Therefore, the feed plate suffering the material pressure from the guide groove is protected from distortion, thanks to the highly rigid die, also enabling an efficient production of the high precision hollow articles at higher extrusion speeds.

The rigid die also protects the feed plate from any deformation thereof that would cause the rotating wheel to scratch said plate to produce chips. Thus, the problem that those chips which have frequently been produced in the prior art apparatuses and taken into the material 'M' to thereby damage the prior art dies is now resolved in the present invention.

What is claimed is:

1. A hollow die for forming a hollow extrudate, comprising:

an axially extending cylindrical body;

a cavity extending coaxially through the body and having an upstream region, a middle region and a downstream region;

a bridge formed integral with the body and extending across the upstream region of said cavity, said bridge containing a slot therein;

a core fixed mounted in said slot of the bridge, said core having bearing tip means operative to form at least one hollow longitudinal space in said extrudate;

the bearing tip means including at least one bearing tip extending from said bridge into the middle region of the cavity; and a female member secured in the downstream region of the cavity and having a forming hole surrounding the bearing tip means and being cooperable therewith to define a forming slit for producing the extrudate.

2. A hollow die as defined in claim 1, wherein the die is adapted for use in the continuous extrusion forming of the hollow article.

3. An apparatus for continuous extrusion forming of hollow articles, the apparatus comprising:

a rotatable extrusion wheel having an outer periphery;

a main guide groove formed about the periphery;

an inner feed plate having an arcuate inner surface and a flat outer surface;

the inner surface being in a sliding contact with the outer periphery of the extrusion wheel;

an auxiliary guide groove formed about the inner surface of said feed plate and disposed in registry with the main guide groove; and a hollow die fixedly supported by the flat outer surface of the inner feed plate, the hollow die comprising:

an axially extending cylindrical body;

a cavity extending coaxially through the body;

a bridge formed integral with the body and extending across an upstream region of the cavity, said bridge containing a slot therein;

a core fixedly mounted in said slot of the bridge, said core having bearing tip means operative to form at least one hollow longitudinal space in said extrudate;

the bearing tip means including at least one bearing tip extending from said bridge into a middle region of the cavity; and a female member secured in a downstream region of the cavity and having a forming hole surrounding the bearing tip means and being cooperable therewith to define a forming slit for producing the extrudate.

4. An apparatus as defined in claim 3, including a seal ring interposed between the hollow die and the flat outer surface of the feed plate.

5. A hollow die as defined in claim 1 in which said bearing tip means includes a plurality of teeth mounting bearing tips in laterally spaced relation along said bridge, said die including a flow regulating plate having a coaxial opening surrounding said bearing tip means and a pair of diametrically spaced lugs, each of said lugs being spaced from the adjacent tooth by an amount corresponding to the spacing between adjacent teeth.

6. A hollow die as defined in claim 3 in which said bearing tip means includes a plurality of teeth mounting bearing tips in laterally spaced relation along said bridge, said die including a flow regulating plate having a coaxial opening surrounding said bearing tip means and a pair of diametrically spaced lugs, each of said lugs being spaced from the adjacent tooth by an amount corresponding to the spacing between adjacent teeth.

* * * * *